US005082102A

United States Patent [19]

Reichmuth

[11] Patent Number: 5,082,102

[45] Date of Patent: Jan. 21, 1992

[54] ESCALATOR SAFETY APPARATUS

[75] Inventor: Hugo Reichmuth, Lucerne, Switzerland

[73] Assignee: Inventio AG, Switzerland

[21] Appl. No.: 489,692

[22] Filed: Mar. 7, 1990

[30] Foreign Application Priority Data

Mar. 9, 1989 [CH] Switzerland ..... 00887/89

[51] Int. Cl.[5] ..... B66B 23/12

[52] U.S. Cl. ..... 198/333

[58] Field of Search ..... 198/333

[56] References Cited

U.S. PATENT DOCUMENTS

| | | | |
|---|---|---|---|
| 3,986,595 | 10/1976 | Asano et al. | 198/333 |
| 4,362,232 | 12/1982 | Saito et al. | 198/333 |
| 4,519,490 | 5/1985 | White . | |
| 4,570,781 | 2/1986 | Kappenhagen . | |
| 4,858,745 | 8/1989 | Haas et al. | 198/333 |

FOREIGN PATENT DOCUMENTS

| | | |
|---|---|---|
| 0297233 | 1/1989 | European Pat. Off. . |
| 8204240 | 12/1982 | PCT Int'l Appl. . |
| 2163716 | 3/1986 | United Kingdom . |

*Primary Examiner*—Joseph E. Valenza
*Attorney, Agent, or Firm*—William J. Clemens

[57] ABSTRACT

An escalator safety apparatus covers the gap between the movable step and the fixed pedestal plates provided at both sides of a treadable stair belt with an elastic synthetic material lip. The lip is formed as a portion of a synthetic material insert section, which insert section can be mounted in corresponding recesses on both sides of step on the horizontal tread surface and on the arcuate riser. The lip adapts to variations in the spacing from the pedestal plate and has a very low coefficient of friction. The clearance for the passage of the step through a comb positioned at the upper and at the lower end of the travel path of the escalator need be enlarged only minimally and the insert with the lip is removable from the step disassembling the step from the stair belt. In alternate embodiments, the lip is formed on a support connected to the insert section.

11 Claims, 2 Drawing Sheets

ESCALATOR SAFETY APPARATUS

BACKGROUND OF THE INVENTION

The present invention relates generally to escalators and, in particular, to a safety apparatus for the elimination of the gaps between the tread surface and/or the riser of a step and stationary pedestal plates located along both sides of a treadable stair belt of an escalator.

Various prior art safety devices for escalators are known for preventing accidents due to wedging-in of articles between the movable steps and adjacent stationary pedestal plates. Some such devices use colored markings along the danger zone of the side edges of the step tread surfaces. Other devices place protective profiles on the outermost lateral edges of the tread surface. Still other devices have upwardly projecting lateral end ribs on the tread surfaces or completely close off of the clearance between the side edges of the steps and the pedestal plates with synthetic material inserts.

One such safety device is shown in U.S. Pat. No. 4,519,490 and has synthetic material bearing means which are clamped securely onto the outermost or onto the adjacent lateral rib of the tread surfaces of the steps. A projecting portion slides against the metal pedestal plates and covers the clearance between each step and the pedestal plate and/or closes it completely by a lateral insert body. In the latter case, a synthetic material of low coefficient of friction relative to the pedestal plates is used. However, the synthetic material parts clamped onto the ribs of the tread surfaces require a relatively large lateral play during the passage of the steps through the combs in the upper and lower horizontal running region of the stair belt.

A disadvantage of the above-described device is that the clamped synthetic material parts can be displaced in the direction of travel of the steps or even torn out of the clamped mounting. There is increased wedging risk due to the lateral play enlarged by an absent or displaced synthetic material part, and increased wedging risk in the region of the entry of the step into the comb through the larger openings required to accommodate the increased lateral play.

The present invention solves the problems associated with the prior art safety devices by providing a protective device which is positioned on both sides of the steps, is firmly and immovably connected with the step and requires no significant enlargement of the entry clearances in the region of the step entry into the comb.

SUMMARY OF THE INVENTION

The present invention concerns an escalator safety apparatus which covers the gap between the movable steps and the fixed pedestal plates provided at both sides of a treadable stair belt. An elastic synthetic material lip is formed as a portion of a synthetic material insert section, which insert section can be mounted in corresponding recesses on both sides of a step on the horizontal tread surface and on the arcuate riser. The lip adapts to variations in the spacing from the pedestal plate and has a very low coefficient of friction. The insert with the lip is removable from the step without disassembling the step from the stair belt.

The lip is firmly and undisplaceably connected with the step at the outer side of the outermost rib of the insert section. The lip does not extend around any of the outer ribs and only minimally projects laterally beyond the outermost rib so that the clearances for the passage of the step through the comb located at the upper end and at the lower end of the treadable conveying path need be enlarged only very little in the regions adjacent the pedestal plates. A further advantage is that if the lip is damaged, it is very simple to install a new lip even by non-experts. The lip can be removed together with the associated insert section and a new insert section with an associated, securely fastened synthetic material lip installed without disassembling the step from the stair belt. The lip can be formed integral with the insert section or as a portion of a body attached to the insert section by clamping, fastening, welding, or the like.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
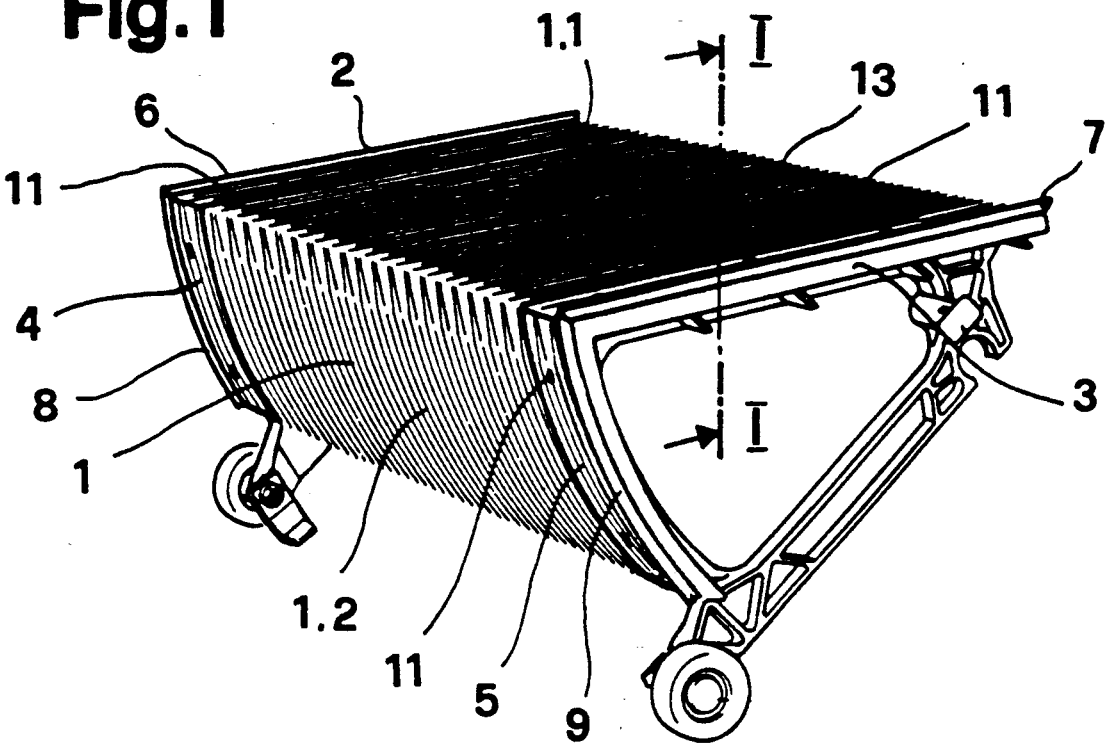
FIG. 1 is a perspective view of an escalator a step including insert sections and lips in accordance with the present invention.
Figure 2:
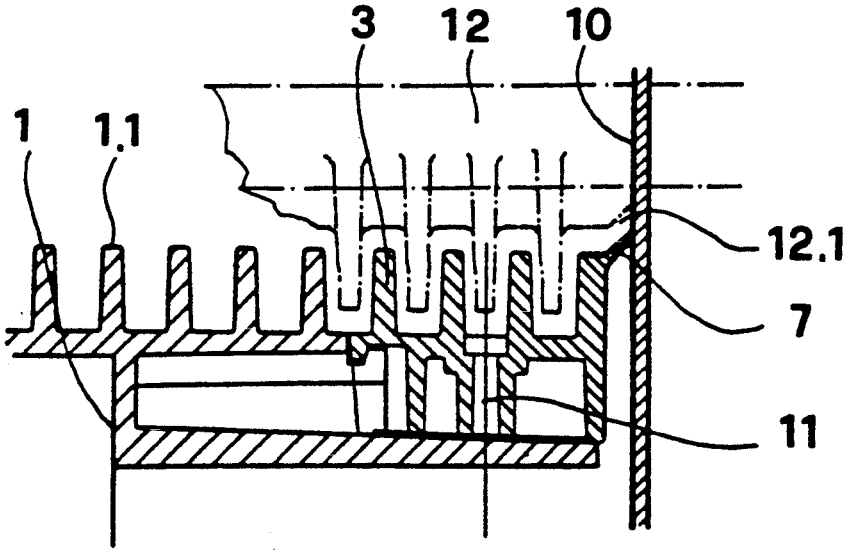
FIG. 2 is a cross-sectional view along the line I—I in FIG. 1.

An escalator step 1 is shown in FIGS. 1 through 5. The step 1 includes a generally horizontally extending tread surface 1.1 and an arcuate, generally vertically extending riser 1.2. On opposite sides of the step 1, straight synthetic material insert sections 2 and 3 are secured along the edges of the tread surface 1.1 and arcuate synthetic material insert sections 4 and 5 are secured along the edges of the riser 1.2. The insert sections 2, 3, 4 and 5 are secured by fasteners such as screws 11 in corresponding recesses of the step 1. A synthetic material connecting insert section 13 is secured with the fasteners 11 at a corresponding recess in the body of the step 1 at the rear edge of the tread surface 1.1 between the ends of the straight synthetic material insert sections 2 and 3.

The straight and the arcuate insert sections 2, 3, 4 and 5 are formed with corresponding elastic synthetic material lips 6, 7, 8 and 9, which lips slidingly abut pedestal plates located on opposite sides of an endless stair belt formed of a plurality of the steps 1. In the FIG. 2, the lip 7 is formed integral with the insert section 3 and abuts a pedestal plate 10. A comb 12 is indicated in phantom, which 10 comb is located in the upper and in the lower entry regions of the escalator where the endless stair belt, according to its running direction, disappears or comes out from below an entry plate (not shown). A slightly enlarged lateral clearance for the passage of the lip 7 through the comb 12 is denoted at 12.1.

Figure 3:
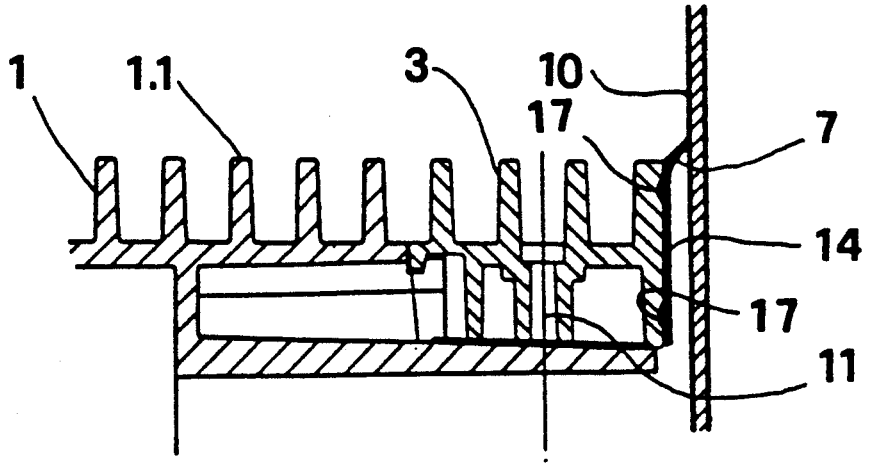
FIG. 3 is a cross-sectional view, similar to FIG. 2, of a first alternate embodiment of the present invention.

In FIG. 3, the lip 7 is formed as a portion of a synthetic material support 14 according to a first alternate embodiment of the present invention. The support 14 has a generally planar body which is attached to the insert section 3 by suitable means such as ultrasonic welding. For example, the body can be welded at a plurality of weld points 17 to a generally vertically extending side surface of the insert section 3.

Figure 4:
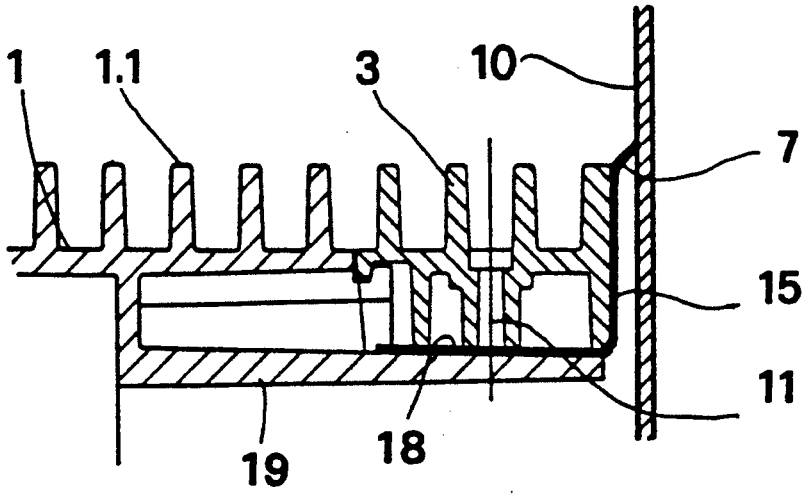
FIG. 4 is a cross-sectional view, similar to FIG. 2, of a second alternate embodiment of the present invention.

In the FIG. 4, the lip 7 is formed as a portion of a synthetic material support 15 according to a second alternate embodiment of the present invention. The support 15 has a generally planar body which extends along a generally vertical side surface of the insert section 3 and includes an extension 18 extending generally horizontally away from the adjacent pedestal plate 10. The extension 18 is trapped between the bottom of the insert section 3 and a top surface of a generally horizontally extending flange 19 formed on the step 1 when the fastener 11 is tightened.

Figure 5:
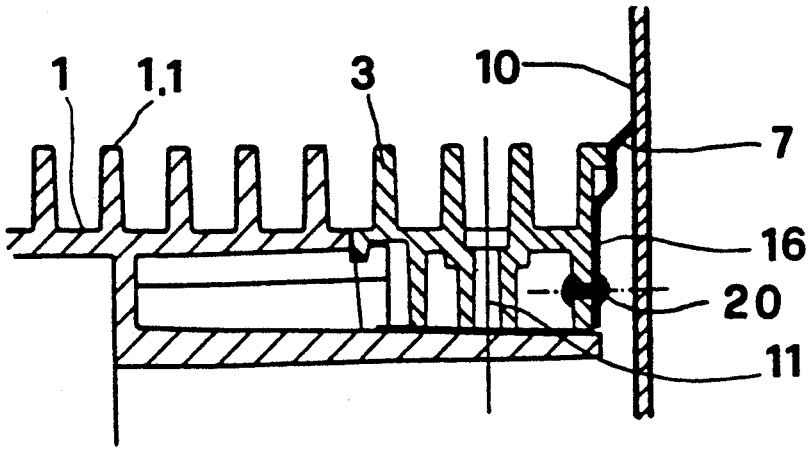
FIG. 5 is a cross-sectional view, similar to FIG. 2, of a third alternate embodiment of the present invention.

In FIG. 5, the lip 7 is formed as a portion of a synthetic material support 16 according to a third alternate embodiment of the present invention. The support 16 has a generally planar body which extends along a generally vertical side surface of the insert section 3 and is secured thereto by a fastener 20 such as a rivet or a screw.

The synthetic material lips 7, illustrated in the FIGS. 2 through 5 for use in the region of the tread surfaces 1.1 of the step 1, are formed the same and function the same in the region of the risers 1.2. However, the synthetic material lips 8 and 9 are appropriately adapted to the arcuate insert sections 8 and 9 and likewise are arcuate.

The above described insert sections and lips are safety equipment which is installed on escalators with a stair belt circulating endlessly in a carrier body. The endlessly circulating stair belt includes a plurality of the steps 1, preferably formed from pressure-cast aluminum, which are articulately connected with a respective endless stair chain on each side. The stair belt is deflected over upper drive chain wheels and lower deflecting chain wheels to form a treadable forward run with a lower and an upper horizontal region and an inclined running region, and a return run concealed in the carrier body. The forward run of the stair belt is located between two lateral hand rail balustrades and guided past a pair of spaced apart fixed pedestal plates 10 with minimum play at both sides.

The clearances between the side edges of the steps 1 and the pedestal plates 10 provide a latent risk of wedging for articles of clothing or body members of the passengers, especially at the transitions of the stair belt from the horizontal to the inclined running region and back, where each individual step carries out relative movements for the formation of a raised tread surface 1.1 or for the horizontal running region. These clearances are covered by the inserts and lips according to the present invention. The lips 6, 7, 8 and 9, which are connected firmly and securely with the movable step 1 in corresponding recesses as part of the insert sections 2, 3, 4 and 5 respectively, lie elastically against the stationary pedestal plates 10. The lips are formed of a material having a very low coefficient of friction and a certain elasticity which permits slight inaccuracies in the pedestal plates 10 to be bridged over and the gap between the steps 1 and the pedestal plates 10 to be covered at all times thereby substantially reducing the risk of wedging.

The lips 6, 7, 8 and 9 are formed so as not to cover any of the outer ribs of the insert sections 2, 3, 4 and 5 and only minimally project laterally beyond the outermost rib. Thus, only the minimally enlarged lateral clearance 12.1 is required for the passage of the step 1 through the comb 12 arranged at the transition from the forward run to the concealed return run of the stair belt. The lips 6, 7, 8 and 9 can be installed on or removed from the step 1 at any time together with the insert sections 2, 3, 4 and 5 without removing the step 1 from the stair belt.

The present invention also can be utilized with escalators having pedestal-free balustrades, wherein the synthetic material lips lie slidingly, instead of against pedestal plates, directly against vertically arranged balustrade plates and so cover the gap between the step and the balustrade plates.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A safety apparatus for eliminating the gap between a tread surface and a riser of a movable step and stationary pedestal plates positioned along both sides of a treadable stair belt of an escalator comprising: a lip formed from an elastic synthetic material, said lip being adapted to slidingly abut a pedestal plate and cover a lateral gap between a tread surface and a riser of an escalator step and the pedestal plate, said lip being connected to an insert section adapted to be removably attached to side edges of the step and wherein said lip is formed on a synthetic material support, said support being attached to a side surface of said insert section by ultrasonic welding.

2. The safety apparatus according to claim 1 wherein said insert section has a plurality of alternating ribs and grooves similar to ribs and grooves formed on the step and said lip is connected at the outer side of the outermost one of said ribs on said insert section.

3. The safety apparatus according to claim 1 wherein said lip is formed integral with said insert section.

4. The safety apparatus according to claim 1 wherein said insert section is formed of a synthetic material.

5. In an escalator having a plurality of steps connected together as a movable treadable stair belt and a pair of stationary pedestal plates positioned along opposite sides of the belt, a safety apparatus for eliminating the gap between a side surface of each step and an adjacent one of the pedestal plates comprising:

a pair of straight insert sections adapted to be removably attached to opposite side edges of a tread surface of an escalator step;

a lip connected to each of said straight insert sections and formed from an elastic material having a relatively low coefficient of friction, each said lip extending in a direction for slidingly abutting an adjacent escalator pedestal plate and wherein each of said lips is formed on a synthetic material support, said support being welded to a side surface of an associated one of said insert sections; and a connecting insert section adapted to be removably attached to a rear edge of the escalator step between said straight insert sections.

6. The safety apparatus according to claim 5 including a pair of arcuate insert sections adapted to be removably attached to opposite side edges of a riser of the escalator step and a lip connected to each of said arcuate insert sections and formed from an elastic material having a relatively low coefficient of friction, each said lip extending in a direction for slidingly abutting an adjacent escalator pedestal plate.

7. The safety apparatus according to claim 6 wherein each of said lips is formed integral with an associated one of said straight insert sections and said arcuate insert sections.

8. A safety apparatus for eliminating the gap between a tread surface and a riser of a movable step and stationary pedestal plates positioned along both sides of a treadable stair belt of an escalator comprising: a lip formed from an elastic synthetic material, said lip being adapted to slidingly abut a pedestal plate and cover a lateral gap between a tread surface and a riser of an escalator step and the pedestal plate, said lip being connected to an insert section adapted to be removably attached to side edges of the step and wherein said lip is formed on a synthetic material support, said support being fastened to a side surface of said inner section.

9. A safety apparatus for eliminating the gap between a tread surface and a riser of a movable step and stationary pedestal plates positioned along both sides of a treadable stair belt of an escalator comprising: a lip formed from an elastic synthetic material, said lip being adapted to slidingly abut a pedestal plate and cover a lateral gap between a tread surface and a riser of an escalator step and the pedestal plate, said lip being connected to an insert section adapted to be removably attached to side edges of the step and wherein said lip is formed on a synthetic material support, said support being clamped between said insert section and a portion of the step.

10. In an escalator having a plurality of steps connected together as a movable treadable stair belt and a pair of stationary pedestal plates positioned along opposite sides of the belt, a safety apparatus for eliminating the gap between a side surface of each step and an adjacent one of the pedestal plates comprising:

a pair of straight insert sections adapted to be removably attached to opposite side edges of a tread surface of an escalator step;

a lip connected to each of said straight insert sections and formed from an elastic material having a relatively lower coefficient of friction, each said lip extending in a direction for slidingly abutting an adjacent escalator pedestal plate and wherein each of said lips is formed on a synthetic material support, said support being fastened to a side surface of an associated one of said insert sections; and a connecting insert section adapted to be removably attached to a rear edge of the escalator step between said straight insert sections.

11. In an escalator having a plurality of steps connected together as a movable treadable stair belt and a pair of stationary pedestal plates positioned along opposite sides of the belt, a safety apparatus for eliminating the gap between a side surface of each step and an adjacent one of the pedestal plates comprising:

a pair of straight insert sections adapted to be removably attached to opposite side edges of a tread surface of an escalator step;

a lip connected to each of said straight insert sections and formed from an elastic material having a relatively low coefficient of friction, each said lip extending in a direction for slidingly abutting an adjacent escalator pedestal plate and wherein each of said lips is formed on a synthetic material support, said support being clamped between an associated one of said insert sections and a portion of the step; and a connecting insert section adapted to be removably attached to a rear edge of the escalator step between said straight insert sections.

* * * * *